US008778163B2

(12) United States Patent
Yu et al.

(10) Patent No.: US 8,778,163 B2
(45) Date of Patent: Jul. 15, 2014

(54) PROTECTION OF MAGNESIUM ALLOYS BY ALUMINUM PLATING FROM IONIC LIQUIDS

(75) Inventors: Xiaomei Yu, Glastonbury, CT (US); Mark R. Jaworowski, Glastonbury, CT (US); Daniel V. Viens, Mansfield Center, CT (US); Joseph J. Sangiovanni, West Suffield, CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 228 days.

(21) Appl. No.: 13/240,021

(22) Filed: Sep. 22, 2011

(65) Prior Publication Data

US 2013/0075271 A1 Mar. 28, 2013

(51) Int. Cl.

| | |
|---|---|
| ***C25D 3/66*** | (2006.01) |
| ***C25D 5/42*** | (2006.01) |
| ***C25D 5/48*** | (2006.01) |
| *C25F 1/12* | (2006.01) |
| *C23C 22/34* | (2006.01) |
| *C23C 28/00* | (2006.01) |

(52) U.S. Cl.

CPC *C25D 3/665* (2013.01); *C25D 5/42* (2013.01); *C25D 5/48* (2013.01); *C25F 1/12* (2013.01); *C23C 22/34* (2013.01); *C23C 28/30* (2013.01)

USPC ..... 205/219; 205/183; 205/210; 205/220; 205/223; 205/233

(58) Field of Classification Search

USPC ..... 205/219, 233, 210, 220

See application file for complete search history.

(56) References Cited

U.S. PATENT DOCUMENTS

| | | | | |
|---|---|---|---|---|
| 4,412,892 | A * | 11/1983 | Chen et al. | 205/216 |
| 4,904,355 | A | 2/1990 | Takahashi | |
| 5,041,194 | A | 8/1991 | Mori et al. | |
| 6,811,672 | B2 * | 11/2004 | Matsuo et al. | 205/238 |
| 7,135,404 | B2 * | 11/2006 | Baskaran et al. | 438/652 |
| 7,891,077 | B2 * | 2/2011 | Lee et al. | 29/594 |
| 2004/0140220 | A1 | 7/2004 | Fischer | |
| 2004/0262165 | A1 * | 12/2004 | Kanda et al. | 205/128 |
| 2009/0236227 | A1 * | 9/2009 | Kuzmanovic et al. | 205/80 |
| 2010/0025255 | A1 * | 2/2010 | Su et al. | 205/176 |

(Continued)

FOREIGN PATENT DOCUMENTS

| | | |
|---|---|---|
| DE | 1129801 | 5/1962 |
| DE | 10025643 | 12/2001 |
| WO | WO2010144509 | 12/2010 |

OTHER PUBLICATIONS

F. A. Lowenheim, Electroplating, McGraw-Hill Book Co., New York, 1978, pp. 86-87.*

(Continued)

*Primary Examiner* — Jeffrey T Barton
*Assistant Examiner* — William Leader
(74) *Attorney, Agent, or Firm* — Cantor Colburn LLP

(57) ABSTRACT

A method for electroplating aluminum metal on a magnesium alloy includes providing an Lewis acidic ionic liquid having dissolved species of an aluminum metal salt; pre-treating a surface of the magnesium alloy including subjecting the surface of the magnesium alloy to a reverse current etching in the ionic liquid; electroplating the aluminum metal on the surface using the ionic liquid as the electrolyte; and subjecting the surface of the magnesium alloy to a post-treatment including neutralization rinsing in a rinsing solvent solution.

18 Claims, 2 Drawing Sheets

(56) References Cited

U.S. PATENT DOCUMENTS

| | | | | |
|---|---|---|---|---|
| 2011/0024299 | A1 | 2/2011 | Reusmann | |
| 2011/0287223 | A1* | 11/2011 | Victor et al. | 428/147 |
| 2012/0052324 | A1* | 3/2012 | Inoue et al. | 428/653 |

OTHER PUBLICATIONS

Chang, et al., Electrodeposition of aluminum on magnesium alloy in aluminum chloride (AlCl3)-1-ethyl-3-methylimidazolium chloride (EMIC) ionic liquid and its corrosion behavior, Electrochemistry Communications 9 (2007) pp. 1602-1606.

Bakkar, et al., Electrodeposition onto magnesium in air and water stable ionic liquids: From corrosion to successful plating, Electrochemistry Communications 9 (2007) pp. 2428-2435.

Gray, et al., Protective coatings on magnesium and its alloys—a critical review, Journal of Alloys and Compounds 336 (2002) pp. 88-113.

EP Application No. 12185345, European Search Report dated Jan. 3, 2013, 7 pages.

Yang, et al., "Electrodeposition of chemically and mechanically protective A1-coatings on AZ91D Mg alloy," Corrision Science, Oxford, GB, vol. 53, No. 1, Jan. 1, 2011, pp. 381-387.

* cited by examiner

PROTECTION OF MAGNESIUM ALLOYS BY ALUMINUM PLATING FROM IONIC LIQUIDS

FIELD OF INVENTION

The subject matter disclosed herein relates generally to the field of electrochemical deposition of aluminum, and more particularly, to electroplating aluminum on magnesium alloys from ionic liquids using combinations of surface treatments and coatings to provide an adherent multi-layered coating providing substantial corrosion resistance.

DESCRIPTION OF RELATED ART

Magnesium alloys are mixtures of magnesium with other metals (called an alloy), often aluminum, zinc, manganese, silicon, copper, rare earths and zirconium. Magnesium alloys have an extremely low density and high strength to weight ratio relative to other structural materials such as steel and aluminum. Due to these excellent mechanical properties, magnesium alloys are cast and used extensively in the aerospace industry.

However, magnesium alloys have a relatively high susceptibility to corrosion. To address the issue, multi-layer coatings including an aluminum coating are applied through conventional methods across the magnesium cast alloy in an attempt to seal the surface from the corrosive environment. Typically, multilayer non-metallic coatings, a cold spray process or a High-Velocity Oxygen Fuel thermal spray (HVOF) process to apply the aluminum coating may be utilized. However, the processes for application of multi-layer coatings are potentially hazardous to the environment, they do not providing satisfactory protection against corrosion and the aluminum coating methods have non-line-of-sight limitations.

Recently, ionic liquids have been used in electrochemical deposition processes for coatings. An ionic liquid is a liquid salt in which the ions are highly unsymmetrical resulting in low lattice energy and low melting point normally below 100 degree Celsius. Many are liquid even at room temperature. Ionic liquids generally have negligible vapor pressure and thus, in contrast to many conventional solvents, produce virtually no hazardous vapors. This makes the ionic liquid an environmentally benign alternative to the conventional hazardous multi-layer coating processes. The fundamental benefits of employing ionic liquids as the electrolyte for electrodeposition are its wide electrochemical window and its reasonably high electrical conductivity. The wide electrochemical window enables electrodeposition of many metals, e.g. aluminum, which cannot be electrodeposited from aqueous based conventional electrolyte due to their more negative redox potential compared to that of hydrogen be possible.

BRIEF SUMMARY

According to one aspect of the invention, a method for electroplating aluminum metal on a magnesium alloy includes providing a Lewis acidic ionic liquid having dissolved species of an aluminum metal salt; subjecting a surface of the magnesium alloy to a pre-treatment process including reverse current etching the surface of the magnesium alloy in the ionic liquid; electroplating the aluminum metal on the surface using the ionic liquid as the electrolyte; and subjecting the surface of the aluminum coated magnesium alloy to a post-treatment including neutralization rinsing in a solvent solution.

According to another aspect of the invention, a method for electroplating aluminum metal on a magnesium alloy includes providing a Lewis acid ionic liquid having dissolved species of an aluminum metal salt; subjecting the magnesium alloy to a conversion treatment bath to form a conversion coating containing magnesium fluoride on the surface; subjecting a surface of the magnesium alloy to a reverse current etching in the ionic liquid; hot-dipping the magnesium alloy in the ionic liquid following the subjecting in the conversion treatment bath; electroplating the aluminum metal on the surface using the ionic liquid as the electrolyte; and subjecting the surface of the magnesium alloy to a post-treatment step including rinsing in a solvent solution to neutralize the ionic liquid on the surface.

Other aspects, features, and techniques of the invention will become more apparent from the following description taken in conjunction with the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

The present invention is more particularly described in the following description and examples are intended to be illustrative only since numerous modification and variations therein will be apparent to those skilled in the art. As used in the specification and in the claims, the singular form "a", "an," and "the" may include plural referents unless the context clearly dictates otherwise. Also, all ranges disclosed herein are inclusive of the endpoints and are independently combinable.

Embodiments of a method for electroprocessing magnesium alloys including electroplating in a Lewis acidic ionic liquid (IL) and neutralization rinsing in a post-treatment process to remove IL remnants that may produce corrosion damage in the presence of moisture. Particularly, the method relates to electroplating aluminum on a magnesium alloy from ionic liquids including a surface pre-treatment of the magnesium alloy and a surface post-treatment of the aluminum coated magnesium alloy to remove residual traces of ionic liquids. The surface pre-treatment includes at least one step to ensure that the surface of the magnesium alloy is clean and free of residues and foreign materials. The plating process enables a dense and thick aluminum film to be uniformly coated on the magnesium alloy substrate using an ionic liquid as an electrolyte. The post-treatment of the magnesium alloy surface includes rinsing, stabilization of the surface, followed by drying the surface of the magnesium alloy. The magnesium alloy in embodiments is a magnesium cast alloy containing zinc, rare earths, and zirconium such as, for example, ZE41A. However, other non-exemplary cast alloys like AZ91, AM60, ZK51, or ZK61, or wrought alloys such as AZ31, AZ61, or ZK60 may be utilized without departing from the scope of the invention.

Figure 1:
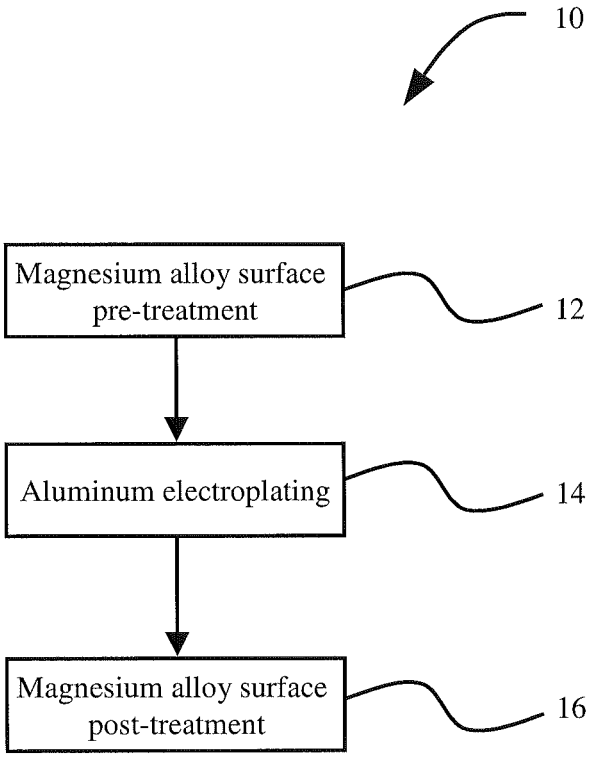
FIG. 1 illustrates a flow chart for an exemplary process for aluminum plating a magnesium alloy from an ionic liquid according to an embodiment of the invention.

Referring now to the drawings, FIG. 1 illustrates an exemplary process 10 to electroplate/electrodeposit a magnesium alloy substrate (or substrate) with aluminum (Al) using an ionic liquid (IL) composition. As shown, the exemplary process is initiated by magnesium alloy surface pre-treatment 12 during which the surface undergoes various treatments to yield a clean surface character suitable for a subsequent electroplating operation and for control of nucleation and adhesion. According to one exemplary process, the magnesium alloy surface preparation includes a mechanical polishing and buffing of the magnesium alloy surface to a smooth finish. Thereafter, any grease, buffing compounds or organic contaminants are removed by a suitable technique such as solvent rinsing, vapor degreasing using trichloroethylene or other suitable chlorinated solvents, solvent emulsion cleaning or the like. In one exemplary embodiment, an aqueous alkaline solution containing surfactant may be utilized in the degreasing bath. The composition of the degreasing bath is not critical as long as the bath can remove organic contaminants.

Following mechanical polishing and degreasing, a reverse current etching process is performed in an ionic liquid (IL) or in an IL bath having an additive. In embodiments, the reverse current etching may be performed in an environment using an inert gas or being blanketed by a liquid of lower density (i.e., mineral oil). The IL reverse etch process is performed to etch the alloy surface and remove any magnesium oxide (MgO) layers that will inhibit good adhesion of the aluminum metal to the surface of the substrate as well as to remove any other foreign contaminants including other surface oxide layers, mold release agents, or other alloying component segregation layers that are present. Preferably, a salt of dialkylimidazolium chloride such as 1-ethyl-3-methylimidazolium chloride with aluminum chloride is used as the IL bath. Reverse current etching involves applying a positive current to the substrate in the IL solution in order to dissolve a thin layer of the magnesium alloy from its surface. In some embodiments, reverse current etching can be applied at various current densities, and as direct current (DC), alternating current (AC), or pulsed current. In one embodiment, reverse current etching is performed with a direct current (DC) in the range of 1-500 $ma/cm^2$, preferably with DC at 5-50 $mA/cm^2$. To reduce cycle time or enhance cleaning performance, alternating or pulsed DC reverse current may be applied.

In an exemplary embodiment, following alkaline cleaning, the magnesium alloy is brought into contact with an aqueous solution containing a phosphoric acid-type compound or sulphuric acid in order to perform a chemical etch prior to reverse current etching. The phosphoric acid may induce the formation of a magnesium phosphate film while at the same time cleaning the magnesium alloy surface. Since the surface of magnesium alloys is chemically heterogeneous, the magnesium phosphate coating will more readily form in the chemically active regions of the magnesium alloy surface. More specifically, this coating will more readily form in regions where the aluminum and zinc alloying components have segregated in relatively high concentrations and in regions that lack a relatively thick oxide coating. Once the surface of the magnesium alloy has been cleaned and coated with a magnesium phosphate coating, the magnesium alloy is rinsed by soaking in an neutralizing cleaner containing caustic soda, non aqueous amines & hydroxide donor compounds, aqueous amines, hydroxides, or other similar cleaners and subjected to a conversion treatment process.

The conversion treatment process is carried out prior to the reverse current etching by bringing the magnesium alloy into contact with a conversion treatment bath. The chemically etched magnesium alloy is immersed in a bath containing an alkali metal fluoride or hydrofluoric acid in sufficient concentrations to develop a surface layer of magnesium fluoride ($MgF_2$). Thereafter, in one exemplary embodiment, the pretreated and dried magnesium alloy is dipped in an ionic liquid containing, for example, 1-ethyl-3-methylimidazolium chloride with aluminum chloride in order to coat the alloy with aluminum. The IL is used in a protective dry environment, as the IL is sensitive to moisture. As will be appreciated by those of skill in the art, these surface preparation procedures are susceptible to a wide array of alternatives. Thus, it is contemplated that any number of other procedures and practices may likewise be utilized to perform the pre-treatment process of the magnesium alloy. In one embodiment, the magnesium alloy treatment process includes chemical etching, followed by a conversion coating process, dried in dry nitrogen gas ($N_2$), followed by reverse current etching, and hot-dipping in an ionic liquid for electroplating. Lastly, the magnesium alloy surface is dried with an inert gas/vacuum drying after the surface pretreatment and before being dipped into the plating bath.

Figure 2A:
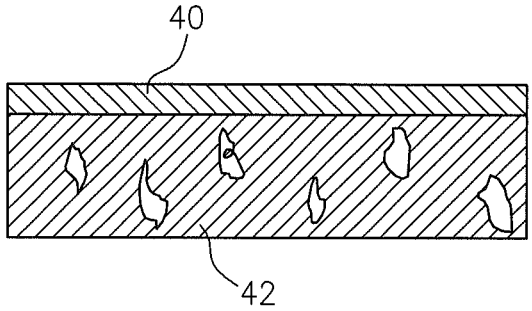
FIG. 2A illustrates a schematic view of an exemplary arrangement of aluminum layers across a magnesium alloy substrate according to an embodiment of the invention.
Figure 2B:
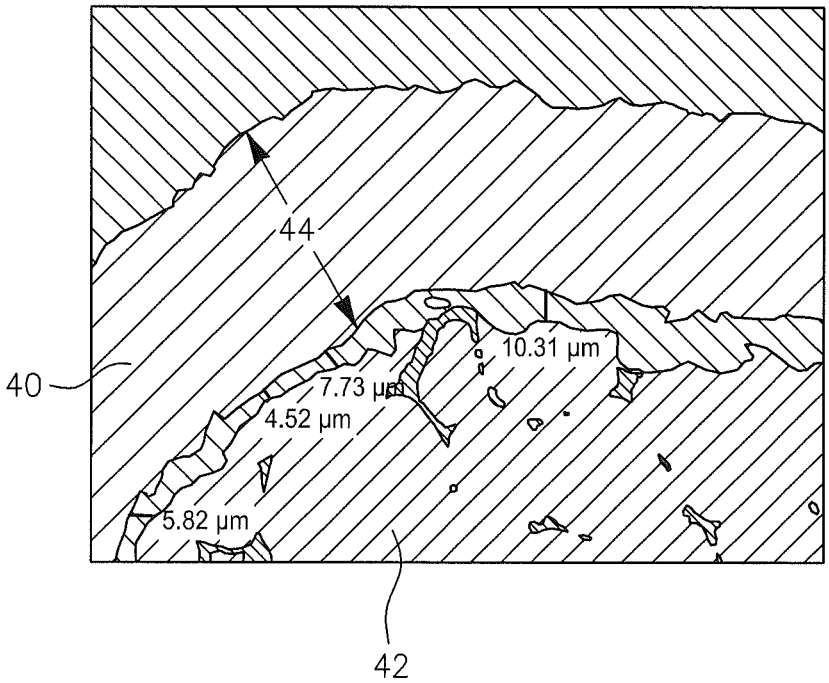
FIG. 2B illustrates surface features of aluminum coated on magnesium alloy as determined from SEM images according to an embodiment of the invention.

Once the magnesium alloy has undergone surface pretreatment, it is thereafter subjected to an aluminum electroplating process 14 in an IL or IL plating bath. As will be recognized by those of skill in the art, the electroplating process includes a power supply or rectifier, which is connected to at least two electrodes (an anode and cathode) that are immersed in an electrolytic bath containing an electrolyte suitable for magnesium substrates. In one exemplary embodiment, the electrolyte utilized is dialkylimidazolium chloride such as aluminum chloride ($AlCl_3$)-1-ethyl-3-methylimidazolium chloride (EMIM-Cl) ionic liquid and includes a nucleation aid additive such as surfactant. In the exemplary embodiment, the $AlCl_3$-EMIM-Cl ionic liquid has a molar ratio of $AlCl_3$ to EMIM-Cl that is greater than 1:1, with a preferable molar ratio of 1.5:1. In another exemplary embodiment, the $AlCl_3$ composition is greater than 50% w/w relative to the ionic liquid (dialkylimidazolium chloride) composition. Additionally, the additives may account for about 10% w/w for the electrolyte solution. In another embodiment, the additive may account for about 0.5-15% w/w. The magnesium alloy is electroplated in the electrolytic bath at a temperature of about room temperature to 90 degrees Celsius in order to enable a dense and thick aluminum film to be uniformly coated on the magnesium alloy substrate, as is illustrated in FIG. 2A-2B. It is to be appreciated that, the use of aluminum cations supplied to the bath is not limited to aluminum chloride and another salt species such as $AlF_x$ compound may be used (with x an integer of 3 in one embodiment) without departing from the scope of the invention. It is also to be appreciated that the additives facilitate modification of the nucleation and growth of the coating as well as facilitate the package and final finish of the coating Following the aluminum electroplating process 14, the aluminum coated magnesium alloy surface is subjected to a surface post-treatment process 16 to terminate any remaining surface reactions that may continue without post-treatment, stabilize the aluminum coated magnesium alloy, and obtain a good final coating for the aluminum. This includes one or more processes to ensure that all of the plating electrolyte and materials other than aluminum plating are effectively removed from the magnesium alloy substrate and no further reactions occur on the alloy. If not completely removed, the residual ionic liquid electrolyte will react with water once exposed to air to form hydrochloric acid. The hydrochloric acid will react with the magnesium alloy substrate and destroy the coating. Additionally, the remaining chloride on the alloy surface may continue with the corrosive effects if not removed during the post treatment process. In one exemplary embodiment, the post-treatment process 16 includes neutralization rinsing (non aqueous amines & hydroxide donor compounds, aqueous amines, hydroxides etc), agitation (for example, high shear rinsing or ultrasonic processing), and blow-drying. In another exemplary embodiment, the post-treatment process 16 includes solvent rinsing under high agitation followed by blow-drying. Exemplary post treatment rinsing solutions include 0.5-2% ethyl amine in acetone, 0.5-5% ammonium hydroxide in water, or other similar types of rinsing solutions. It is to be appreciated that the post-treatment process 16 facilitates the removal of any IL that may be present on the surface of the coated magnesium alloy as remnants of the IL may react with water and create hydrochloric acid, which could damage the magnesium alloy or the surface aluminum coating.

With reference to FIG. 2A-2B, an exemplary view of the layers on the magnesium alloy is presented. In this regard, FIGS. 2A-2B are presented as an aid to understanding the relative positional relationship of the aluminum layer 40 in the illustrated exemplary construction. In the exemplary construction shown in FIG. 2A, a base of magnesium alloy 42 is coated with a layer of aluminum 40 according to the aforementioned processed shown and described in FIG. 1. In another exemplary embodiment taken from a scanning electron microscope combined with X-ray dispersion (SEM/EDX) and shown in FIG. 2B, the layer of aluminum 40 on the magnesium alloy 42 may have a thickness 44 of about 70 micrometer.

The technical effects and benefits of exemplary embodiments include a method for corrosion protection of magnesium alloy by providing a dense and thick Al film uniformly coated on a magnesium alloy substrate using an ionic liquid.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for electroplating aluminum metal on a magnesium alloy comprising:

providing a Lewis acidic ionic liquid having dissolved species of an aluminum metal salt;

subjecting a surface of the magnesium alloy to a pre-treatment process including reverse current etching the surface of the magnesium alloy in the ionic liquid;

electroplating the aluminum metal on the surface using the ionic liquid as the electrolyte; and subjecting the surface of the aluminum coated magnesium alloy to a post-treatment including neutralization rinsing the aluminum coated magnesium alloy in a solvent solution of ethyl amine in acetone.

2. The method of claim 1, wherein the pre-treatment process further comprises subjecting the magnesium alloy to a conversion treatment bath to form a conversion coating containing magnesium fluoride on the surface.

3. The method of claim 2, further comprising hot-dipping the magnesium alloy in the ionic liquid following the subjecting in the conversion treatment bath.

4. The method of claim 2, wherein the pre-treatment process further comprises chemically etching the surface of the magnesium alloy with an aqueous solution containing an acid prior to the subjecting in the conversion treatment bath.

5. The method of claim 1, wherein the molar ratio of the aluminum metal salt to the ionic liquid is greater than 1:1.

6. The method of claim 1, wherein the molar ratio of the aluminum metal salt to the ionic liquid is greater than 1.5:1.

7. The method of claim 1, wherein the reverse current etching is provided with a direct current in the range of about 5 to 50 $mA/cm^2$.

8. The method of claim 1, wherein the ionic liquid includes a surfactant as a coating nucleation and growth aid.

9. The method of claim 1, wherein the post-treatment further comprises blow-drying the magnesium alloy in air.

10. The method of claim 1, wherein the solvent solution is 0.5-2% ethyl amine in acetone.

11. A method for electroplating aluminum metal on a magnesium alloy comprising:

providing a Lewis acid ionic liquid having dissolved species of an aluminum metal salt;

subjecting the magnesium alloy to a conversion treatment bath to form a conversion coating containing magnesium fluoride on the surface;

hot-dipping the magnesium alloy in the ionic liquid following the subjecting in the conversion treatment bath;

subjecting a surface of the magnesium alloy to a reverse current etching in the ionic liquid;

electroplating the aluminum metal on the surface using the ionic liquid as the electrolyte; and subjecting the surface of the aluminum coated magnesium alloy to a post-treatment including neutralization rinsing the aluminum coated magnesium alloy in a solvent solution of ethyl amine in acetone.

12. The method of claim 11, wherein the molar ratio of the aluminum metal salt to the ionic liquid is greater than 1:1.

13. The method of claim 11, wherein the molar ratio of the aluminum metal salt to the ionic liquid is greater than 1.5:1.

14. The method of claim 11, wherein the reverse current etching is provided with a direct current in the range of about 5 $mA/cm^2$ to about 50 $mA/cm^2$.

15. The method of claim 11, wherein the ionic liquid includes a surfactant as a coating nucleation and growth aid.

16. The method of claim 11, wherein the post-treatment step further comprises blow-drying the magnesium alloy in air.

17. The method of claim 11, further comprising chemically etching the surface of the magnesium alloy with an aqueous solution containing an acid.

18. The method of claim 11, wherein the solvent solution is 0.5-2% ethyl amine in acetone.

* * * * *